United States Patent [19]

Tai

[11] Patent Number: 4,497,716

[45] Date of Patent: Feb. 5, 1985

[54] FABRIC SOFTENING COMPOSITION

[75] Inventor: Ho T. Tai, Santes, France

[73] Assignee: Lever Brothers Company, New York, N.Y.

[21] Appl. No.: 561,850

[22] Filed: Dec. 15, 1983

[30] Foreign Application Priority Data

Dec. 23, 1982 [GB] United Kingdom ..... 8236650

[51] Int. Cl.[3] ..... D06M 13/16; D06M 13/18; D06M 13/20

[52] U.S. Cl. ..... 252/8.8; 252/8.6

[58] Field of Search ..... 252/8.8

[56] References Cited

U.S. PATENT DOCUMENTS

| | | | |
|---|---|---|---|
| 3,681,241 | 8/1972 | Rudy | 252/8.75 |
| 3,793,196 | 2/1974 | Okazaki et al. | 252/8.8 |
| 4,140,641 | 2/1979 | Ramachandran | 252/8.75 |
| 4,151,097 | 4/1979 | Nelson | 252/8.6 |
| 4,237,016 | 12/1980 | Rudkin | 252/8.8 |
| 4,351,737 | 9/1982 | Billenstein et al. | 252/8.8 |

FOREIGN PATENT DOCUMENTS

| | | |
|---|---|---|
| 888535 | 8/1981 | Belgium . |
| 406 | 1/1979 | European Pat. Off. . |
| 4121 | 9/1979 | European Pat. Off. . |
| 13780 | 8/1980 | European Pat. Off. . |
| 18039 | 10/1980 | European Pat. Off. . |
| 22555 | 1/1981 | European Pat. Off. . |
| 23334 | 2/1981 | European Pat. Off. . |
| 23333 | 2/1981 | European Pat. Off. . |
| 40562 | 12/1981 | European Pat. Off. . |
| 43547 | 1/1982 | European Pat. Off. . |
| 56695 | 7/1982 | European Pat. Off. . |
| 74056 | 3/1983 | European Pat. Off. . |
| 2905881 | 8/1980 | Fed. Rep. of Germany . |
| 1314381 | 4/1923 | United Kingdom . |
| 1104441 | 4/1961 | United Kingdom . |
| 1282428 | 7/1972 | United Kingdom . |
| 1397507 | 6/1975 | United Kingdom . |
| 1456913 | 12/1976 | United Kingdom . |
| 1459935 | 1/1977 | United Kingdom . |
| 1482782 | 7/1977 | United Kingdom . |
| 2007734 | 5/1979 | United Kingdom . |
| 1550205 | 7/1979 | United Kingdom . |
| 1562961 | 3/1980 | United Kingdom . |
| 1571527 | 7/1980 | United Kingdom . |
| 1596250 | 9/1981 | United Kingdom . |
| 1601359 | 10/1981 | United Kingdom . |
| 1599036 | 10/1981 | United Kingdom . |
| 2031941 | 6/1982 | United Kingdom . |

*Primary Examiner*—Maria Parrish Tungol
*Attorney, Agent, or Firm*—James J. Farrell

[57] ABSTRACT

A concentrated fabric softening composition comprises at least 10% cationic fabric softener, up to 4% ethoxylated nonionic material selected from ethoxylated amides, alcohols, acids and esters with not more than 7EO groups per molecule, 0.02 to 0.5% of an electrolyte and less than 2.5%, if any, of an alkanol with 1–4 carbon atoms.

6 Claims, No Drawings

FABRIC SOFTENING COMPOSITION

The present invention relates to a fabric softening composition and a method for its use. In particular, it relates to an aqueous based concentrated fabric softening composition.

It is known to treat fabrics, particularly after washing, with fabric softening agents in order to improve the feel of the fabrics and, in the case of clothes, to improve the comfort in wear. Traditionally, fabric softening agents are applied from an aqueous liquor which is made up by adding a relatively small volume of a fabric softening composition to a large volume of water, for example during the rinse cycle in an automatic washing machine. The fabric softening composition is usually an aqueous liquid product containing less than about 8% of a cationic fabric softening agent which is quaternary ammonium or imidazolinium salt. Such compositions are normally prepared by dispersing in water a cationic raw material, which contains short chain alkanols, such as isopropanol, as a solvent. For a number of reasons, including for example the cost of packaging, it would be preferred if the product were to contain more than 10% of the active ingredient but due to difficulties in manufacture, storage and ease of use of the products, it has only been possible to do this in the past with some difficulty.

Thus it has been proposed to form low viscosity concentrated products by the use of ionisable salts (U.S. Pat. No. 3,681,241), fatty acids, fatty alcohols, fatty esters and paraffinic hydrocarbons (European Patent Specification No. 13780). However, these proposals are not totally satisfactory. In the case of the ionisable salts there is a tendency for the product to gellify on contact with water, while in the case of the other proposals mentioned above the viscosity increases unacceptably with several days' storage.

It is particularly important that products will be stable at low temperatures, for example at −4° C. Storage conditions may be such that, in practice, the product may be kept for some days at temperatures as low at −4° C. between manufacture and use. It is therefore an object of this invention to provide products which are stable to prolonged storage at low temperatures.

It has also been proposed (European Patent Specification No. 56695) to control the viscosity of concentrated products by the use of small quantities of alkoxylated amines. While it may have been thought that the viscosity control results from some interaction between the alkyl-nitrogen groups of the amine and the cationic softening agent, we have now surprisingly found that such viscosity control can not only be achieved with alkoxylated amines, but also with a range of other alkoxylated nonionic materials, provided the level of short chain alkanol in the product is controlled.

Thus, according to the present invention there is provided a concentrated liquid fabric softening composition comprising an aqueous base, at least 10% by weight of a water-insoluble cationic fabric softening agent, up to 4% of a nonionic viscosity control agent and from 0.02% to 0.5% by weight of an electrolyte, characterised in that the nonionic viscosity control agent is an alkylene oxide adduct of a fatty compound selected from fatty amides, fatty alcohols, fatty acids and fatty esters, said fatty compound containing at least 10 carbon atoms and each molecule of the alkylene oxide adduct containing an average of not more than 7 alkylene oxide groups per molecule, and in that the composition contains not more than 2.5% by weight of a monohydric alkanol having 1 to 4 carbon atoms.

The cationic fabric softening agent is preferably present at a level of from 10% to 25%, most preferably between 10% and 18% by weight, and may be selected from quaternary ammonium salts, imidazolinium salts, mixtures thereof and mixtures thereof with water-insoluble fatty amines, in particular water-insoluble tertiary fatty amines.

Preferred cationic softener materials are di-$C_{12}$–$C_{24}$ alkyl or alkenyl 'onium salts, especially mono- and polyammonium salts, and imidazolinium salts. Optionally, the two long chain alkyl or alkenyl groups may be substituted or interrupted by functional groups such as OH, —O—, CONH—, —COO—, ethyleneoxy, propyleneoxy etc.

Well known species of substantially water-insoluble mono-ammonium compounds are the quaternary ammonium and amine salt compounds having the formula:

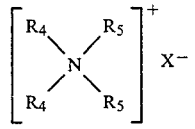

wherein each $R_4$ represents alkyl or alkenyl groups of from about 12 to about 24 carbon atoms optionally interrupted by amide, propyleneoxy groups etc. Each $R_5$ represents hydrogen, alkyl, alkenyl or hydroxyalkyl groups containing from 1 to about 4 carbon atoms; and X is the salt counteranion, preferably selected from halide, methyl sulphate and ethyl sulphate radicals. Representative examples of these quaternary softeners include ditallow dimethyl ammonium chloride, ditallow dimethyl ammonium methosulphate; dihexadecyl dimethyl ammonium chloride; di(hydrogenated tallow alkyl)dimethyl ammonium chloride; dioctadecyl dimethyl ammonium chloride; dieicosyl dimethyl ammonium chloride; didocosyl dimethyl ammonium chloride; di(hydrogenated tallow)dimethyl ammonium methyl sulphate; dihexadecyl diethyl ammonium chloride; di(coconut alkyl)dimethyl ammonium chloride; di(coconut alkyl)dimethyl ammonium methosulphate; di(tallowyl amido)ethyl dimethyl ammonium chloride and di(tallowyl amido)ethyl methyl ammonium methosulphate. Of these ditallow dimethyl ammonium chloride and di(hydrogenated tallow alkyl)dimethyl ammonium chloride are preferred.

Another preferred class of water-insoluble cationic materials are the alkyl imidazolinium salts believed to have the formula:

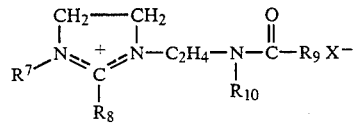

wherein $R_7$ is hydrogen or an alkyl containing from 1 to 4, preferably 1 or 2 carbon atoms, $R_8$ is an alkyl containing from 12 to 24 carbon atoms, $R_9$ is an alkyl containing from 12 to 24 carbon atoms, $R_{10}$ is hydrogen or an alkyl containing from 1 to 4 carbon atoms and X is the salt counteranion, preferably a halide, methosulphate or ethosulphate. Preferred imidazolinium salts include 3-methyl-1-(tallowylamido)ethyl-2-tallowyl-4,4-dihydroimidazolinium methosulphate and 3-methyl-1-(palmitoylamido)ethyl-2-octadecyl-4,5-dihydroimidazolinium chloride. Other useful imidazolinium materials are 2-heptadecyl-3-methyl-1-(2-stearylamido)-ethyl-4,5-dihydroimidazolinium chloride and 2-lauryl-3-hydroxyethyl-1-(oleylamido)ethyl-4,5-dihydro imidazolinium chloride.

Representative commercially available materials of the above classes are the quaternary ammonium compounds Arquad 2HT (ex AKZO); Noranium M2SH (ex CECA); Aliquat-2HT (Trade Mark of General Mills Inc) and the imidazolinium compounds Varisoft 475 (Trade Mark of Sherex Company, Columbus, Ohio) and Steinquat (Trade Mark of REWO).

The amines which may be present with the quaternary ammonium salts or the imidazolinium salts include tertiary amines of the formula:

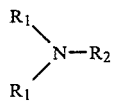

where $R_1$ is $C_{10-22}$ alkyl, and $R_2$ is $C_{1-4}$ such as Noram M2C (dicoconut methyl amine); Noram M2SH (dihardened tallow methyl amine) (ex CECA). When a tertiary amine is present, it will usually be present at a level less than that of the quaternary ammonium or imidazolinium salt.

The nonionic viscosity control agent is preferably present at a level of about 0.2% to about 3% by weight and is preferably selected from the following compounds:

(a) alkoxylated fatty acid amides of the general formula:

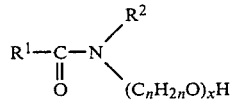

wherein $R^1$ is an alkyl group having from 10 to 22 carbon atoms, $R^2$ is hydrogen, an alkyl group having from 1 to 3 carbon atoms or the group $(C_nH_{2n}O)_xH$, x is, in total, from 1 to 5, preferably 2 to 4 and n is 2 or 3; such as ETHOMID 0/15 or HT15 ie oleylamide 5EO or hardened tallow amide 5EO (ex AKZO);

(b) alkoxylated fatty alcohols of the general formula:

$$R^3—O—(C_nH_{2n}O)_yH$$

wherein $R^3$ is an alkyl or alkylaryl group having from 10 to 22 carbon atoms, y is from 1 to 5, most preferably from 2 to 3, and n is 2 or 3 (such as Synperonic A3 [ICI], $C_{13-15}$ alcohol 3EO, Empilan KB3-lauric alcohol 3EO—ex Marchon);

(c) alkoxylated fatty acids of the general formula:

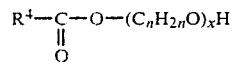

wherein $R^4$ is an alkyl group having from 10 to 22 carbon atoms, x is from 1 to 5, preferably 2 to 4 and n is 2 or 3; such as ESONAL 0334 (Diamond Shamrock)—tallow fatty acid 2.4 EO;

(d) alkoxylated mono-, di- or tri-esters of polyhydric alcohols containing 1 to 4 carbon atoms; such as coconut or tallow oil (triglyceride) 3EO ex Stearine Dubois; and (e) mixtures of one or more from any of the above classes (a) to (d).

The viscosity of the product when measured at 110 $sec^{-1}$ shear rate should be less than 150 mPa sec, preferably between 20 and 100 mPa sec and can be used as such or may be pre-diluted with water before adding to the rinse liquor.

Preferably, the compositions of the invention contain only minor amounts, most preferably substantially no non-ethoxylated nonionic materials, other than the amine, when present.

Essentially, the compositions further include an electrolyte, at a level of from about 0.02% to 0.5%, preferably from about 0.05% to about 0.4%, measured as the anhydrous salt. Examples of suitable materials include sodium chloride, ammonium chloride, sodium methosulphate, sodium benzoate, calcium chloride, magnesium chloride or aluminum chlorhydrate, phosphoric acid, hydrochloric acid.

The compositions will usually include a solvent for the cationic fabric softener. Commercially available fabric softeners often contain considerably quantities of solvents, in particular iso-propanol. We have found that it is essential to ensure that the composition contains no more than about 2.5% by weight of iso-propanol or any other monohydric alcohol having 1 to 4 carbon atoms. In particular it is beneficial if the weight ratio of the cationic fabric softener to such a solvent is at least about 6:1. Where the commercially available fabric softener contains too much of such solvents, they can be removed simply by distillation.

Additionally the composition can contain substances for maintaining stability of the product in cold storage. Examples of such substances include polyhydric alcohols such as ethylene glycol, propylene glycol, glycerol and polyethylene glycol. A suitable level for such materials is from about 0.5% to about 5%, preferably about 1.0 to 2.0% by weight.

The compositions of the invention may further include other additional ingredients including colourants, perfumes, preservatives, anti-foams, optical brighteners, opacifiers, pH buffers, further viscosity modifiers, non-cationic fabric conditioning agents, anti-shrinkage agents, anti-wrinkle agents, fabric crisping agents, spotting agents, soil-release agents, germicides, anti-oxidants and anti-corrosion agents.

The compositions of the present invention preferably contain substantially no anionic material, in particular no anionic surface active materials. If such anionic materials are present the weight ratio of the cationic material to the anionic material should preferably be more than 10:1, most preferably more than about 100:1.

The compositions of the present invention may be prepared by heating, to a temperature above the Krafft point of the cationic material and stirring, a mixture of demineralised water and electrolyte. The cationic fabric softener and monohydric alcohol, if any, is then added with further stirring. After the mixture has become fluid the nonionic viscosity control agent and the polyhydric alochol, if any, is added. The mixture is then cooled quickly to below the said Krafft point with further stirring. Finally, volatile ingredients such as preservatives and perfumes may be added. Non volatile further ingredients such as colourants may be added at any stage. The process may be carried out batchwise or continuously.

An alternative process consists in heating demineralised water to a temperature above the Krafft point (transition temperature) of the cationic/nonionic mix, typically about 55° C. and adding phosphoric acid and dye if desired. After mixing in a static mixer, the cationic material is added at a temperature above the Krafft point, say at 60° C. The mixture should then be thoroughly mixed, without cooling, to such an extent that the cationic material is transformed from a lamellar phase to spherical particles. At this stage the nonionic, electrolyte and perfume, if desired, are added. The composition is then mixed again with a static mixer and cooled in a heat exchanger, leaving the heat exchanger at a temperature close to the Krafft point, say about 28° C.

Where the ethoxylated nonionic material is substantially water-insoluble, such as tallow ethanolamide, the above process can be modified by forming a premix of the cationic and nonionic materials, and adding the premix to water at an elevated temperature with mixing. The electrolyte is then added to the mixture while still hot. After cooling, volatile components such as perfume may be added.

The invention will now be illustrated by the following Examples. It is to be noted that all parts and percentages quoted herein are by weight based on the total weight of the composition. Comparative Examples, directed to compositions outside the scope of the invention, are indicated by *.

EXAMPLE 1

A liquid fabric softening composition was made as follows. Demineralised water was added under stirring to a vessel together with calcium chloride and a blue dye in the form of a 1% solution. The mixture was heated to a temperature between 45° C. and 50° C. Then, a commercial cationic fabric softener containing dihardened tallow dimethyl ammonium chloride, isopropanol and water was added at a temperature of about 65° C. with further stirring. After about 5 minutes when the mixture had become fluid coconut diethanolamide was added. The mixture was then cooled to a temperature of 28°-30° C. with continuous stirring. Finally formalin as a preservative and a silicone antifoam material were added. In this Example, the amounts of the component materials used were such that the final product had the following composition:

| | |
|---|---|
| Cationic | 12.5% |
| Calcium chloride | 0.3% |
| Coconut ethanolamide | 2.0% |
| Isopropanol | 1.66% |
| Dye, minor components and water | balance |

The product was evaluated by measuring its viscosity at 110 $sec^{-1}$ after 1 day and after 2 weeks. The results were 40 mPa sec and 58 mPa sec respectively. The condition of the product at −4° C. was examined and was found to be liquid.

EXAMPLES 2 AND 3

Example 1 was repeated except that alternative supplies of cationic material were used, which contained higher levels of isopropanol. Where the final product contained 2.49% isopropanol (Example 2), the viscosity after 1 day and 2 weeks was 70 mPa sec and 105 mPa sec respectively. Where the final product contained 3.32% isopropanol (Example 3*) the viscosities were 110 mPa sec and more than 150 mPa sec respectively. In both cases the product was very thick at −4° C. These examples demonstrate the benefit of maintaining the short chain monohydric alkanol level in the product at not more than 2.5%.

EXAMPLES 4 AND 5

Example 1 was repeated except that different levels of calcium chloride were used. Where the final product contained no calcium chloride (Example 4*) the product was a paste at room temperature and very thick at −4° C. Where the final product contained 0.6% calcium chloride (Example 5*) the viscosity after 1 day was 24 mPa sec and after 2 weeks it was 48 mPa sec, but phase separation had occurred. At −4° C. the product was very thick. These Examples demonstrate the benefit of maintaining the electrolyte level between 0.02% and 0.5%.

EXAMPLES 6 TO 9

Example 1 was repeated except that the coconut diethanolamide was replaced by alternative nonionics according to the invention.

Where the composition contained 2.0% by a $C_{13-15}$ alcohol 3EO (Example 6), the viscosity after 1 day was 60 mPa sec and after 2 weeks it was 75 mPa sec. At −4° C. the product was liquid.

Where the composition contained 1.0% of oleylamide 5EO (Example 7), the viscosities were 40 mPa sec and 70 mPa sec respectively. The product was liquid at −4° C.

Where the composition contained 1.0% of oleic acid 2.5EO (Example 8), the viscosities were 60 mPa sec and 84 mPa sec respectively and the product was liquid at −4° C.

Where the composition contained 1.0% of tallow fatty acid 2.5EO (Example 9), the viscosities were 65 mPa sec and 76 mPa sec respectively and the product was liquid at −4° C.

These Examples demonstrate that the coconut diethanolamide of Example 1 can be satisfactorily replaced with alkoxylated fatty alcohols, fatty amides and fatty acids.

EXAMPLES 10 TO 16

Example 1 was repeated except that the 2.0% coconut diethanolamide was replaced by mixtures of nonionics according to the invention.

Where the composition contained 1.0% coconut diethanolamide and 1.0% tallowylamide 5EO (Example 10), the viscosities after 1 day and 2 weeks were 38 mPa sec and 70 mPa sec respectively. The product was liquid at −4° C.

Where the composition contained 1.0% coconut diethanolamide and 1.0% oleyl amide 5EO (Example 11), the viscosities were 42 mPa sec and 58 mPa sec respectively and the product was liquid at −4° C.

Where the composition contained 1.0% coconut diethanoamide and 0.5% tallow fatty acid 2.5EO (Example 14), the viscosities were 35 mPa sec and 52 mPa sec respectively and the product was liquid at −4° C.

Where the composition contained 1.0% coconut diethanolamide and 1.0% $C_{12}$ alcohol 3EO (Example 15), the viscosities were 27 mPa sec and 34 mPa sec respectively and the product was liquid at −4° C.

Where the composition contained 2.0% coconut diethanolamide and 1.0% $C_{13-15}$ alcohol 3EO (Example 16), the viscosities were 44 mPa sec and 62 mPa sec respectively. The product was liquid at −4° C.

EXAMPLES 17 AND 18

Example 1 was repeated except that 2.0% of a polyhydric alcohol was included to maintain the stability of the product on cold storage. The polyhydric alcohol was added together with the coconut diethanolamide.

Where the polyhydric alcohol was ethylene glycol (Example 17), the viscosities after 1 day and 2 weeks were 34 mPa sec and 72 mPa sec respectively, and the product was liquid at −4° C.

Where the polyhydric alcohol was glycerol (Example 18), the viscosities were 32 mPa sec and 58 mPa sec respectively, and the product was liquid at −4° C.

EXAMPLES 19 TO 21

Example 6 was repeated except that the $C_{13-15}$ alcohol 3EO was replaced by ethoxylated alcohols having a higher degree of ethoxylation.

When the ethoxylated alcohol was $C_{13-15}$ alcohol 7EO (Example 19), the viscosities of the product after 1 day and 2 weeks were 50 mPa sec and 80 mPa sec respectively, and the product was liquid at −4° C.

When the ethoxylated alcohol was $C_{13-15}$ alcohol 11EO (Example 20*), the viscosity of the product after 1 day and 2 weeks was 110 and more than 150 mPa sec respectively and the product was thick at −4° C.

These examples demonstrate the benefit of the alkoxylated nonionic material containing not more than 7 alkylene oxide groups per molecule.

EXAMPLES 22 AND 23

Example 6 was repeated except that the level of $C_{13-15}$ alcohol 3EO was increased.

When the level of ethoxylated alcohol was 2.5% (Example 22), the viscosity of the product after a day was 50 mPa sec.

When the level of ethoxylated alcohol was 5.0% (Example 23*), the viscosity of the product after 1 day was more than 150 mPa sec.

These Examples demonstrate the benefit of maintaining the level of nonionic viscosity control agent at not more than 4%.

EXAMPLES 24 TO 26

Example 1 was repeated except that the 2.0% coconut diethanolamide was replaced by an alkoxylated fatty ester or mixtures thereof with other nonionic viscosity control agents.

Where the coconut diethanolamide was replaced with 2.5% of a glyceryl ester of an ethoxylated oleic acid (3EO) (Example 24), the viscosity after 1 day was 68 mPa sec.

Where the coconut diethanolamide was replaced with 0.5% of the ethoxylated ester used in Example 24 and 1.5% lauric monoethanolamide (Example 25), the viscosity after 1 day was 68 mPa sec.

Where the coconut diethanolamide was replaced with 0.5% of the ethoxylated ester and 1.0% $C_{13-15}$ alcohol 3EO (Example 26), the viscosity after 1 day was 48 mPa sec.

EXAMPLES 27 AND 28

Example 1 was repeated except that the coconut diethanolamide was replaced in one case with an alkoxylated nonionic viscosity control agent according to the invention and in another case by an alkoxylated amine as taught by EP 56695.

When the nonionic viscosity control agent was $C_{13-15}$ alcohol 2EO, used at a level of 2.5% (Example 27) the viscosity after 1 day was 50 mPa sec.

When the coconut diethanolamide of Example 1 was replaced by 2.5% tallowyl amine 2EO (Example 28*), the viscosity after 1 day was more than 150 mPa sec.

These Examples demonstrate the superiority of the nonionic materials of the present invention over the alkoxylated amines taught by the prior art.

Similar results to the above Examples 1 to 28 can be obtained if the calcium chloride is replaced totally or partially by sodium chloride or phosphoric acid and also where a minor proportion of the cationic material is replaced with, for example, di-coconut alkyl methyl amine.

EXAMPLE 29

The following product was prepared by forming a premix of the cationic material and the tallow ethanolamide, adding the premix to water at a temperature slightly above the melting point of the premix with mixing and thereafter adding the calcium chloride. After cooling, the perfume was added.

The product had the following composition:

| Ingredients (%) | |
|---|---|
| Arquad 2HT (cationic fabric softener closely similar to that used in Example 1) | 12.0 |
| Tallow mono ethanolamide | 4.0 |
| Calcium chloride | 0.05 |
| Perfume | 0.75 |
| Water | balance |

The viscosity of this product was measured initially and after storage for various times at room temperature and also after storage at 37° C. for 4 weeks. The results were as follows:

| | Viscosity (mPa sec) |
|---|---|
| Initial viscosity | 115 |
| 1 week at room temperature | 110 |
| 4 weeks at room temperature | 93 |
| 4 weeks at 37° C. | 84 |

EXAMPLES 30 TO 34

Using the method described in Example 29, products according to the following formulations were prepared:

| | EXAMPLE NO: | | | | |
|---|---|---|---|---|---|
| Ingredients (%) | 30 | 31 | 32 | 33 | 34 |
| Arquad 2HT | 14.0 | 14.0 | 14.0 | 16.0 | 16.0 |
| Coconut diethanolamide | 3.5 | — | — | 4.0 | — |
| Tallow monoethanolamide | — | 3.5 | — | — | — |
| Isostearic diethanolamide | — | — | 3.5 | — | 4.0 |
| Calcium chloride | 0.05 | 0.05 | 0.05 | 0.05 | 0.05 |
| Water and perfume | | | balance | | |

All these products were stable liquids at −4° C.

I claim:

1. A concentrated liquid fabric softening composition comprising an aqueous base, at least 10% by weight of a water-insoluble cationic fabric softening agent, from 0.02% to 0.5% by weight of an electrolyte and from 0.2% to 4% of a nonionic viscosity control agent which comprises an alkylene oxide adduct of a fatty compound selected from the group consisting of fatty amides, fatty alcohols, fatty acids and fatty esters, said fatty compound containing at least 10 carbon atoms and each molecule of the alkylene oxide adduct containing an average of not more than 7 alkylene oxide groups per molecule and from 0% to 2.5% by weight of a monohydric alkanol having 1 to 4 carbon atoms.

2. A composition according to claim 1, wherein the water-insoluble cationic fabric softening agent is selected from the group consisting of quaternary ammonium salts, imidazolinium salts, water-insoluble fatty amines and mixtures thereof.

3. A composition according to claim 1, wherein the weight ratio of the cationic fabric softening agent to the alkanol is at least about 6.1.

4. A composition according to claim 1, wherein the nonionic viscosity control agent is selected from the group consisting of compounds having the following general formulae:

(a)

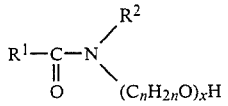

wherein $R^1$ is an alkyl group having from 10 to 22 carbon atoms, $R^2$ is hydrogen or an alkyl group having from 1 to 3 carbon atoms or the group $(C_nH_{2n}O)_xH$, x is, in total, from 1 to 5, and n is 2 or 3;

(b)

$$R^3—O—(C_nH_{2n}O)_yH$$

wherein $R^3$ is an alkyl or alkylaryl group having from 10 to 22 carbon atoms, y is from 1 to 5, and n is 2 or 3;

(c)

$$R^4—\underset{\underset{O}{\|}}{C}—O—(C_nH_{2n}O)_xH$$

wherein $R^4$ is an alkyl group having from 10 to 22 carbon atoms, x is from 1 to 5 and n is 2 or 3;

(d) alkoxylated mono-, di or tri-esters of polyhydric alcohols containing 1 to 4 carbon atoms and mixtures thereof.

5. A composition according to claim 1, which comprises from 0.2% to 3% by weight of the viscosity control agent.

6. A composition according to claim 1, which comprises from 10% to 25% by weight of the water-insoluble cationic fabric softening agent;

from 0.5% to 3% by weight of the nonionic viscosity control agent; and from 0.05% to 0.5% by weight of the electrolyte and from 0 to 2.5% isopropyl alcohol.

* * * * *